US006125749A

United States Patent [19]

Jones

[11] Patent Number: 6,125,749

[45] Date of Patent: Oct. 3, 2000

[54] APPARATUS AND METHOD FOR APPLYING LIQUIDS TO SCREENPRINTING SCREENS

[75] Inventor: Simon Peter Jones, Wantage, United Kingdom

[73] Assignee: Autotype International Limited, Wantage, United Kingdom

[21] Appl. No.: 09/290,600

[22] Filed: Apr. 13, 1999

[30] Foreign Application Priority Data

Apr. 15, 1998 [GB] United Kingdom ..... 9807880

[51] Int. Cl.[7] ..... B41F 7/00

[52] U.S. Cl. ..... 101/129; 101/425

[58] Field of Search ..... 101/129, 115, 101/123, 425; 134/109, 110, 111

[56] References Cited

U.S. PATENT DOCUMENTS

| | | | |
|---|---|---|---|
| Re. 17,275 | 4/1929 | Schultz | 101/425 |
| 3,405,683 | 10/1968 | Jons et al. | 101/425 |
| 3,673,954 | 7/1972 | Lala | 101/115 |
| 5,865,117 | 2/1999 | Asai et al. | 101/425 |
| 5,954,071 | 9/1999 | Magliocca | 134/109 |

FOREIGN PATENT DOCUMENTS

| | | | |
|---|---|---|---|
| 0204655 | 4/1986 | European Pat. Off. | 101/425 |
| 8702416 | 5/1989 | Netherlands | 101/425 |
| 2088284A | 6/1982 | United Kingdom | 101/425 |

*Primary Examiner*—Eugene Eickholt
*Attorney, Agent, or Firm*—Seidel, Gonda, Lavorgna & Monaco, PC

[57] ABSTRACT

The apparatus comprises a washing chamber and a washing brush on the end of a hose leading to a reservoir for liquid to be applied. The hose is connected to an outlet pipe of the reservoir having a one-way valve which is immersed in liquid in the reservoir and allows movement of the brush to pump liquid from the reservoir to the chamber. Liquid supplied to the chamber is collected in a sump, the overflow of which feeds the reservoir. A filter screen is positioned between the chamber and the sump, in which solid material precipitates, allowing liquid to be recycled. The apparatus can be used, for example, for removal of ink from a used screen, removal of stencil material from a used screen or application of a degreasing preparation to a screen prior to use.

10 Claims, 4 Drawing Sheets

APPARATUS AND METHOD FOR APPLYING LIQUIDS TO SCREENPRINTING SCREENS

BACKGROUND TO THE INVENTION

1. Field of the Invention

This invention relates to apparatus and methods for applying liquids to screenprinting screens in, for example, washing operations.

2. Related Background Art

Many operations carried out in the pre-press stages of screenprinting processes involve the application of liquids to frame-mounted screenprinting screens. One such operation is the removal of residual ink from the screen mesh after printing has been carried out. The liquid used for this purpose is typically based on a non-aqueous solvent, in which the residual ink is soluble. Another such operation is the removal of stencil material from the mesh, at the end of the print run for which the stencil was prepared. The liquid used for this operation typically contains periodate or hypochlorite ions as the active agents. The liquids used, in these operations and others, at least after contact with the materials and articles involved, often present either health risks to the operator (making their containment desirable) or cause environmental problems in their disposal. Further, solids typically accumulate in the liquids applied. In the first example, these are sludges derived from the inks; in the second example, the solids are the removed stencil material.

An apparatus for washing-down serigraphical frames is described in U.S. Pat. No. 5,547,567. The apparatus described is however complex and has the disadvantage of including a pump, which needs an external power supply, and switching valves, all of which require maintenance.

U.S. Pat. No. 5,056,948 describes a screen cleaning apparatus which is also complex and includes a scanning spray head and pneumatically powered pumps for removing residue and cleaning fluid.

The present invention seeks to overcome or alleviate these disadvantages.

An object of the invention is accordingly to provide an apparatus and method for applying liquid to a screenprinting screen which does not require any external power or services, including electricity, air and water.

It is a further object to provide such an apparatus which has few moving parts and requires little maintenance.

Another object is to provide such an apparatus which has no electrical parts nor any moving parts liable to produce a spark and therefore gives rise to no significant risk of spark-ignited fire during use.

A further object is to provide such a machine which is constructed of materials which are resistant to a wide range of solvents and other chemicals.

A still further object is to provide such an apparatus which can be used in a recirculation mode, or can be used for single application of liquids.

SUMMARY OF THE INVENTION

The invention provides an apparatus for applying a liquid to a screenprinting screen, comprising a chamber for receiving a screenprinting screen to which a liquid is to be applied, the chamber having at its lower part an outlet for the liquid after contact with the screen, a reservoir for the liquid applied positioned below the chamber, and a liquid-application means comprising a conduit having an inlet end positioned for immersion in liquid in the reservoir and extending to a dispensing device to allow for supply of liquid from the reservoir to a screenprinting screen positioned in the chamber, at least a portion of the conduit being flexible, and the conduit having at its inlet end a one-way valve which allows flow of liquid into the conduit and which, upon movement of the dispensing device relative to the inlet end of the conduit, allows liquid to be drawn from the reservoir to the dispensing device.

Preferably, the outlet of the chamber is connected to the reservoir to provide for recycling a liquid to the liquid-application means.

More preferably, a liquid-collection sump is positioned to receive liquid from the outlet of the chamber, an outlet, conveniently an overflow, from the sump communicating with the reservoir for flow of overflow liquid from the sump to the reservoir.

The sump advantageously has a drain outlet in its lower region.

This drain outlet can be used for removal of precipitated solids, or can be used for outflow of liquid from the sump thus allowing the apparatus to be used in a non-recirculatory mode.

A filter means is advantageously positioned between the outlet of the chamber and the inlet of the sump. The filter means is conveniently a filter screen extending across an upper part of the sump.

Conveniently, the one-way valve comprises a flexible flap member movable within a valve housing positioned for immersion in liquid in the reservoir.

The dispensing device may be a brush having bristles and, adjacent thereto, outlets for liquid which are in communication with the conduit.

The invention also provides a method of applying liquid to a screenprinting screen, comprising positioning the screen for application of liquid thereto, positioning a vessel containing the liquid at a level beneath that of the screen, inserting into the liquid in the vessel the inlet end of a liquid-application means comprising a conduit extending from an inlet end to a dispensing device, the conduit being flexible over at least part of its length and having adjacent its inlet end a one-way valve which allows flow of liquid into the conduit and which, upon movement of the dispensing device relative to the inlet end of the conduit, allows liquid to be drawn from the vessel to the dispensing device, and moving the dispensing device relative to the inlet end to supply liquid to the screen.

GB-A-890052, GB-A-1442306 and GB-A-2256678 describe self-powered water-raising devices. The entire contents of each of these three documents are incorporated herein by reference.

BRIEF DESCRIPTION OF THE DRAWINGS

An embodiment of the invention will now be described by way of example with reference to the drawings of this specification, in which.

DETAILED DESCRIPTION OF THE INVENTION

Figure 1:
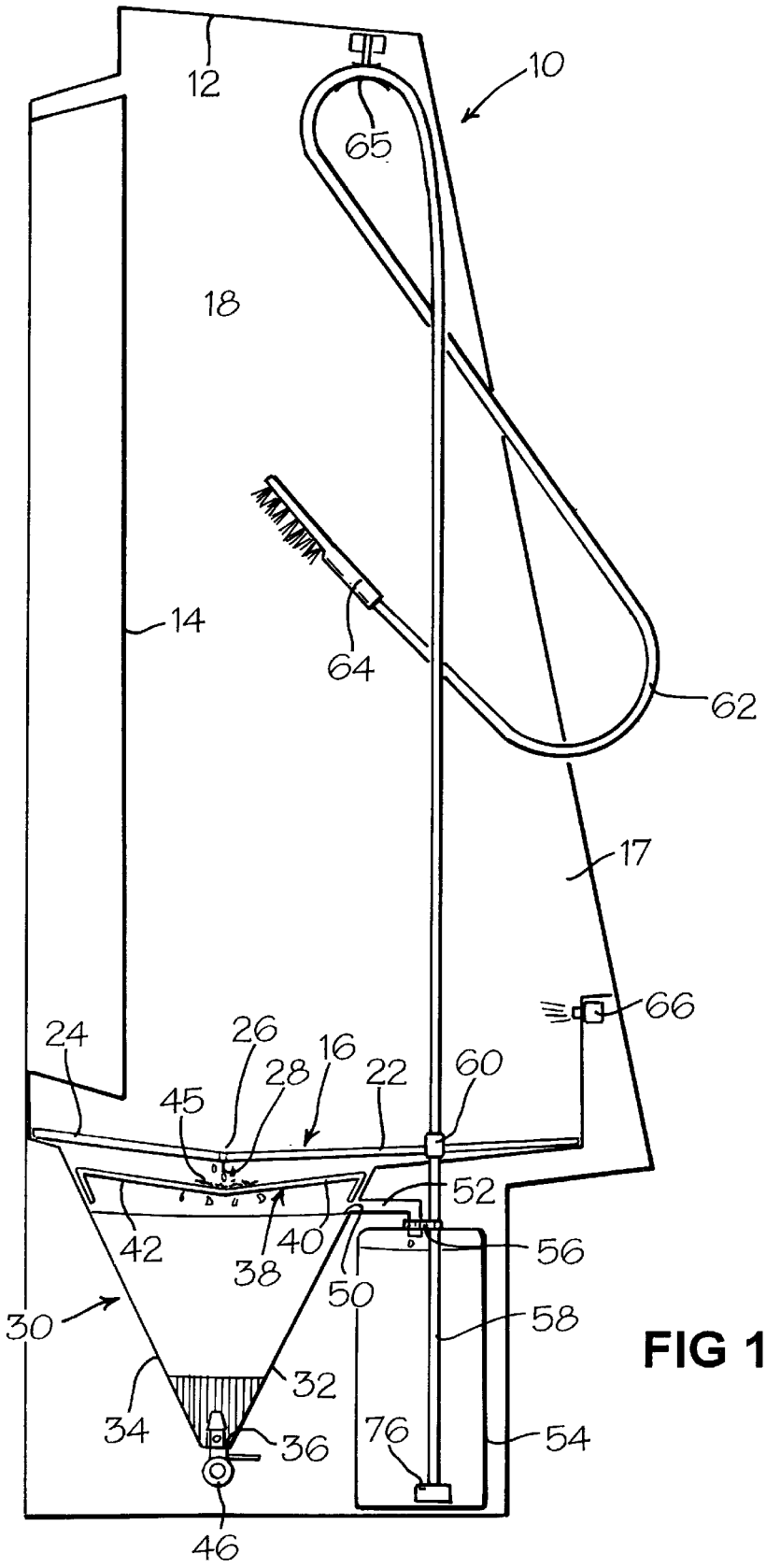
FIG. 1 is a somewhat schematic transverse vertical sectional view through an apparatus for washing-out of screen printing screens.
Figure 2:
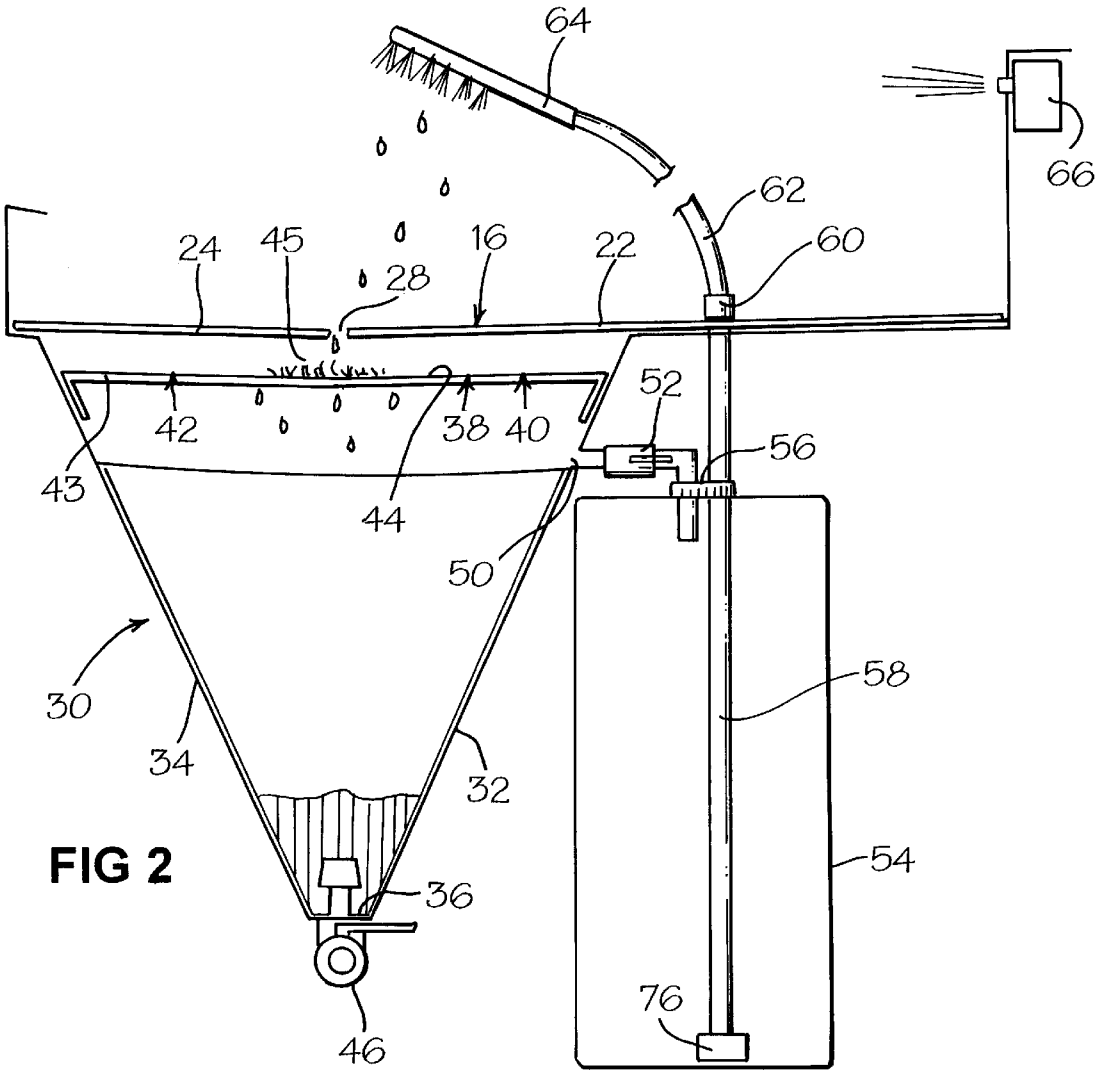
FIG. 2 is an enlarged view of the lower portion of the apparatus of FIG. 1.

Referring to FIG. 1, this shows a washing cabinet 10 which has a top wall 12, a back wall 14, a floor 16 and end walls 17 defining a washing chamber 18. The washing cabinet has any convenient dimensions to receive in the chamber 18 a screenprinting screen to which liquid is to be applied.

The floor 16 of the chamber 18 has a front portion 22 and a rear portion 24. The front and rear portions 22, 24 form a shallow V-shape in transverse vertical section and meet along a line 26 along which are formed a series of spaced holes 28 through which liquid can drain from the front and rear portions 22, 24 of the floor 16.

Positioned beneath the floor 16 and extending along the full width of the wash-down chamber 18 is a sump 30 which has a truncated V-section formed by front and rear longitudinal walls 32, 34 and a narrow floor 36. Positioned in the top of the sump 30 and immediately beneath the floor 16 of the washing chamber 18 is a filter screen 38 which has front and rear portions 40, 42 which form a shallow V-shape having a similar angle to the angle formed by the front and rear portions 22, 24 of the floor 20 of the chamber 18. The filter screen 38 is a two-layer structure consisting of a lower mesh layer 43, on which a layer 44 of loose matting lies. The matting layer is of a chemically resistant fibrous material, for example glass fibre or polypropylene. Suitable materials for both layers are disclosed in U.S. Pat. No. 5,547,567. The two-layer filter screen 38 separates solid material 45 such as ink sludge and stencil material from recycled screens. Further solid material separates in the sump 30 which has an outlet tap 46 in its floor 36 so the sump can be emptied of accumulated solid and drained of liquids as required. If desired, the tap can be connected by a hose or pipework to a suitable receptacle or drain.

Adjacent the upper end of the front wall 32 of the sump 30 is an overflow opening 50 which leads to an overflow pipe 52 which feeds into a liquid collection reservoir 54 which is positioned alongside the sump 50 in the lower part of the cabinet 10 beneath the floor 16.

The overflow pipe 52 passes through a top opening 56 of the reservoir 54.

An outlet pipe 58 of the reservoir extends downwardly from the front portion 22 of the cabinet floor 16 where it passes through a hole in the floor 16 and is secured by a union 60 which allows sliding movement of the outlet pipe 58 relative to the floor 16. The outlet pipe 58 extends into the reservoir 54 alongside the overflow pipe 52.

A flexible hose 62 is attached to the union 60 and is in communication with the outlet pipe 58. The hose 62 extends to a washing brush 64 which has openings in its head communicating with the hose 62. The hose 62 is of sufficient length to allow the brush 64 to reach the most distant upper extremities of the chamber 18. A guide 64 is attached to the top wall 12 of the cabinet 10 to guide the hose 62 during use of the apparatus and also when the apparatus is not in use.

Along the lower edge of the open front of the washing cabinet 10 a series of nozzles 66 are positioned, out of which air is blown to form an air curtain to hinder escape of fumes from the chamber 18. The air curtain may, if desired, be used in combination with a fume extraction system (not shown) for exhausting fumes from the chamber 18.

Figure 3:
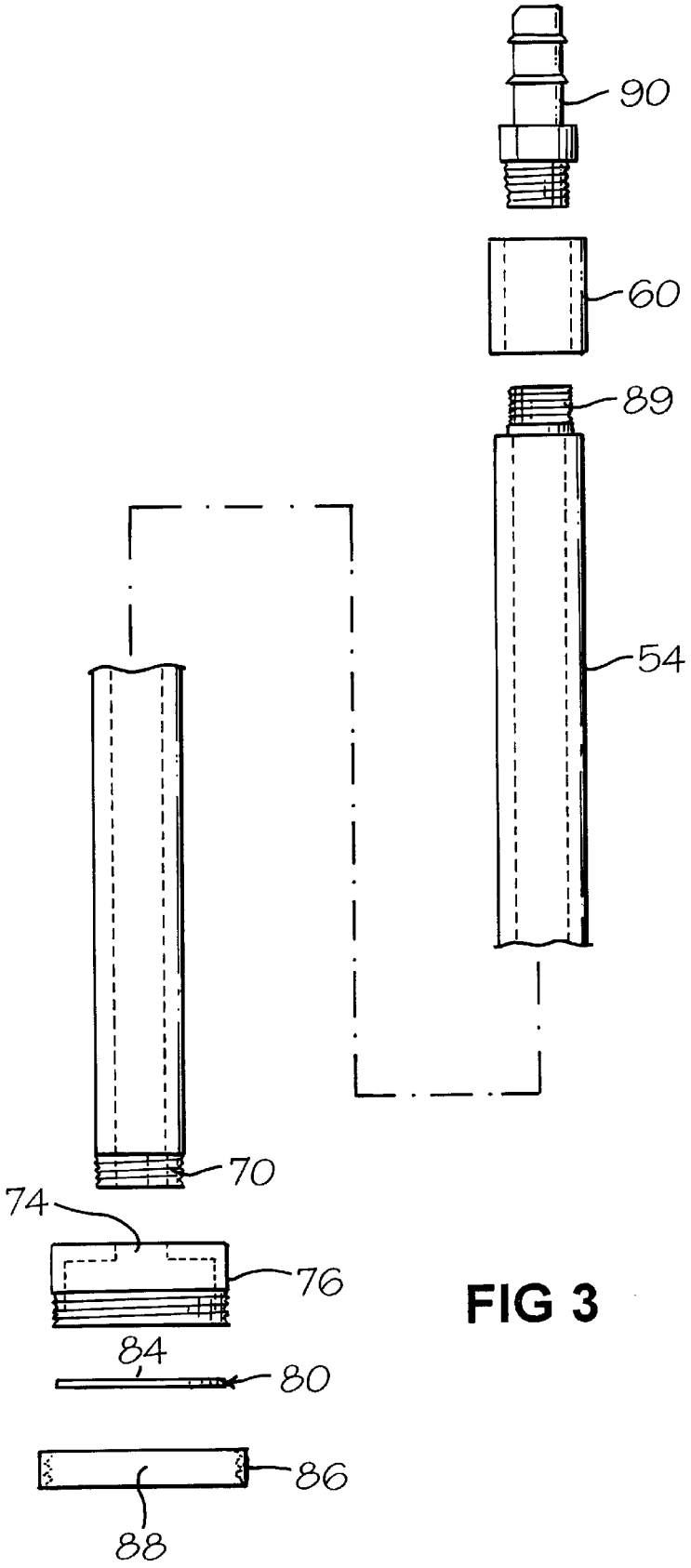
FIG. 3 is an exploded side view of a part of the apparatus of FIG. 1.

FIG. 3 of the drawings shows in more detail the outlet pipe 58 of the reservoir 54 and the union 60 by which the outlet pipe 58 is secured in the floor 16 of the chamber 18.

Figure 5:
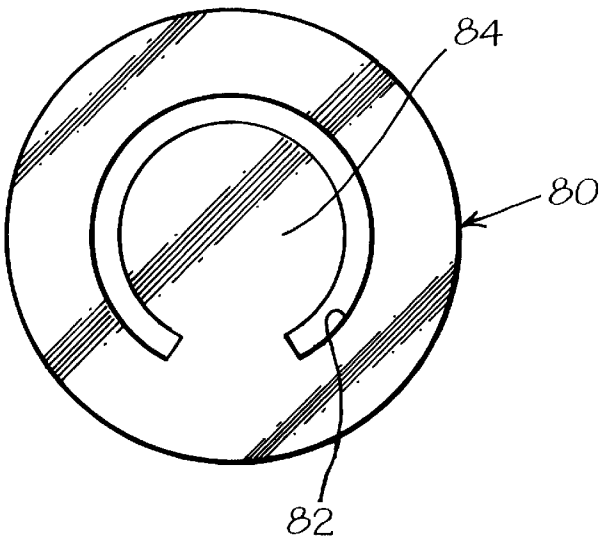
FIG. 5 is a plan view of a component of the apparatus shown in FIG. 3.

The lower end of the outlet pipe 58 is formed with an external screw thread 70 which can be engaged with a complementary internal screw thread (not shown) around the inner surface of an outlet opening 74 of a cylindrical valve housing 76. The valve housing 76 contains a valve member 78 which is shown in FIG. 5 and is formed as a disk 80 of a flexible and chemically resistant material, for example biaxially orientated polyethyleneterephthalate, of thickness in the range 50 to 175 $\mu$m. The disk 80 is 30 mm in diameter and has a slot of 1 mm width which extends of about 320° of a circular arc, the inner diameter of the slot being 18 mm. The central part 84 of the disk 80 therefore forms a flap valve which allows liquid to flow through the valve in the inlet direction only (upwards as shown in FIG. 3). The disk 80 is secured in the valve housing 76 by a collar 86 which is in screw-threaded engagement with around the outer surface of the housing 76. The collar 86 has a central opening 88 which forms the inlet opening of the valve.

The upper end of the outlet pipe 54 has a screw thread 89 which is received in the union 60 which also receives a push-on hose fitting 90 on which the hose 62 is a push fit.

Figure 4:
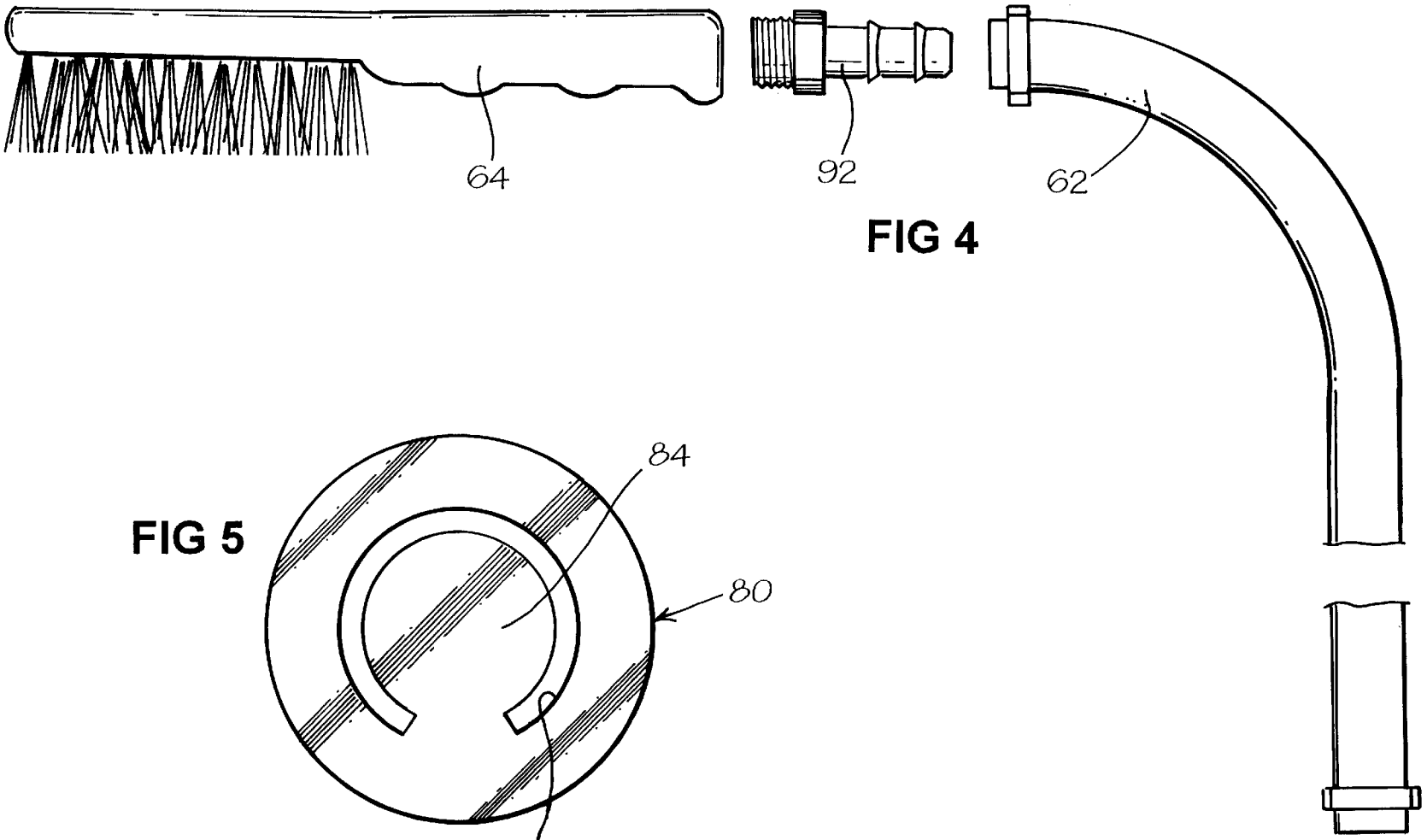
FIG. 4 is an exploded side view of a further part of the apparatus of FIG. 1.

FIG. 4 shows the hose 62 and brush 64 in more detail and also shows the hose 62 is connected to the brush 64 by means of a further push-on hose fitting 92 which is a screw-fit in the brush 64 and on which the hose 62 is a push-fit.

In a modified apparatus, not shown in the drawings, the sump 30 and its associated filter screen 38 and overflow pipe 52 are omitted from the apparatus. Liquid drawn from the floor 16 of the chamber 18 through the holes 26 is then allowed to run to waste which, after any treatment necessitated by local water regulations, is discharged with other liquid effluent. In this modified apparatus, the liquid is not re-circulated. The modified apparatus is particularly suitable for use in the application of degreasing preparations to screen meshes before application of stencil materials, such preparations often being suitable for direct discharge with other liquid effluent, possibility after treatment if water regulations require it.

Furthermore, the apparatus described with reference to the drawings can be used in a non-recirculatory mode either by closing or redirecting the overflow pipe 52 and allowing liquid draining from the chamber 18 simply to accumulate in the sump or overflow to waste, or by allowing draining liquid to flow to waste through the top 46 which is opened.

The use of the apparatus described with reference to the drawings will now be described. It will be assumed that the apparatus is to be used to remove residual ink or stencil material from a screenprinting screen to which a stencil film has been applied and used. The screen is to be treated with an appropriate solvent, or with a stencil-removal preparation.

The screen comprising a mesh mounted in a frame is first placed in the chamber 18. The reservoir 54 is then filled with the appropriate liquid and the hose 62 primed by first loosening the cap 56 of the reservoir 54 and then moving the outlet pipe 58 several times up and down by about 20 cm, the union 60 allowing for this movement which has the effect of forcing liquid into the pipe where it is retained by the one-way valve. Continued up and down movement results in liquid being forced into the hose 62 which, when partially filled, can be filled further by up and down movement of the brush 64. Further movement of the brush 64 over the screen in the wash-out operation causes liquid to be drawn through the one-way valve into the outlet pipe 58 of the reservoir 54 and to be discharged from the brush 64 where it is applied to the screen. Once the system is primed as described, the reservoir 54 can be exchanged for another containing the same or a different liquid, without the need to prime again.

The liquid flowing from the screen collects on the floor 20 of the chamber 18, drains through the holes 28 in the floor and, after passing through the filter screen 38, collects in the sump 30, solid material 45 that is held by the filter screen 38 accumulating thereon. In the sump 30, further solid material carried through the screen 38 precipitates and the supernatant liquid flows through the overflow 50 of the sump and then by way of the overflow pipe 52 to the reservoir 54 where it is retained for recycling.

The apparatus described with reference to the drawings has the following advantageous features:

- it does not require any external power or services, including electricity, air and water;
- it has few moving parts and requires little maintenance;
- it has no electrical parts nor any moving parts liable to produce a spark and therefore gives rise to no significant risk of spark-ignited fire during use;
- it is constructed of materials which are resistant to a wide range of solvents and other chemicals;
- the rate of application of liquid can be controlled by the operator by variation of the proportion of vertical movement of the brush compared with horizontal movement;
- the reservoir 54 is closed, except for the overflow pipe 52, so the likelihood of spillage and the loss of solvent by evaporation is reduced and
- it can be used as described in a recirculation mode, or can be used for single application of liquids, as also described.

It should be understood that the invention is not limited to the particular embodiments shown herein but that various changes and modifications may be made without departing from the spirit and scope of the invention.

I claim:

1. An apparatus for applying a liquid to a screenprinting screen, comprising a chamber for receiving a screenprinting screen to which a liquid is to be applied, the chamber having at its lower part an outlet for the liquid after contact with the screen, a reservoir for the liquid applied positioned below the chamber, and a liquid-application means comprising a conduit having an inlet end positioned for immersion in liquid in the reservoir and extending to a dispensing device to allow for supply of liquid from the reservoir to a screenprinting screen positioned in the chamber, at least a portion of the conduit being flexible, and the conduit having at its inlet end a one-way valve which allows flow of liquid into the conduit and which, upon movement of the dispensing device relative to the inlet end of the conduit, allows liquid to be drawn from the reservoir to the dispensing device.

2. An apparatus according to claim 1, in which the outlet of the chamber is connected to the reservoir.

3. An apparatus according to claim 2, in which a liquid-collection sump is positioned to receive liquid from the outlet of the chamber, an overflow from the sump communicating with the reservoir for flow of overflow liquid from the sump to the reservoir.

4. An apparatus according to claim 3, in which the sump has a drain outlet in its lower region.

5. An apparatus according to claim 3, having a filter means positioned between the outlet of the chamber and the inlet of the sump.

6. An apparatus according to claim 5, in which the filter means is a filter screen extending across an upper part of the sump.

7. An apparatus according to claim 1, in which the one-way valve comprises a flexible flap member movable within a valve housing positioned for immersion in liquid in the reservoir.

8. An apparatus according to claim 1, in which the dispensing device is a brush having bristles and, adjacent thereto, outlets for liquid which are in communication with the conduit.

9. An apparatus according to claim 1, in which the reservoir is located beneath the lower part of the chamber.

10. A method of applying liquid to a screenprinting screen, comprising positioning the screen for application of liquid thereto, positioning a vessel containing the liquid at a level beneath that of the screen, inserting into the liquid in the vessel the inlet end of a liquid-application means comprising a conduit extending from an inlet end to a dispensing device, the conduit being flexible over at least part of its length and having adjacent its inlet end a one-way valve which allows flow of liquid into the conduit and which, upon movement of the dispensing device relative to the inlet end of the conduit, allows liquid to be drawn from the vessel to the dispensing device, and moving the dispensing device relative to the inlet end to supply liquid to the screen.

* * * * *